US005304259A

United States Patent [19]

Miyakusu et al.

[11] Patent Number: 5,304,259

[45] Date of Patent: Apr. 19, 1994

[54] CHROMIUM CONTAINING HIGH STRENGTH STEEL SHEET EXCELLENT IN CORROSION RESISTANCE AND WORKABILITY

[75] Inventors: Katsuhisa Miyakusu, Yamaguchi; Masayuki Kinugasa, Hiroshima; Yoshihiro Uematsu, Yamaguchi; Takashi Igawa, Yamaguchi; Hiroshi Fujimoto, Yamaguchi, all of Japan

[73] Assignee: Nisshin Steel Co., Ltd., Tokyo, Japan

[21] Appl. No.: 47,520

[22] Filed: Apr. 19, 1993

Related U.S. Application Data

[63] Continuation-in-part of Ser. No. 907,512, Jul. 1, 1992, abandoned, which is a continuation-in-part of Ser. No. 811,376, Dec. 20, 1991, abandoned.

[30] Foreign Application Priority Data

Dec. 28, 1990 [JP] Japan ..... 2-415495

[51] Int. Cl.[5] ..... C22C 38/20; C22C 38/24

[52] U.S. Cl. ..... 148/325; 148/333; 420/104; 420/70; 420/112

[58] Field of Search ..... 148/325, 333, 657; 420/70, 109, 104, 112

[56] References Cited

U.S. PATENT DOCUMENTS 4,790,977 12/1988 Daniels et al. .
5,017,246 5/1991 Miyasaka et al. ..... 420/104

FOREIGN PATENT DOCUMENTS 56-152950 11/1981 Japan .
64-53344 3/1989 Japan .
2-50940 2/1990 Japan .
2-156048 6/1990 Japan .

*Primary Examiner*—Deborah Yee
*Attorney, Agent, or Firm*—Lowe, Price, LeBlanc & Becker

[57] ABSTRACT

A high strength chromium containing steel sheet having a tensile strength of at least 40 kgf/mm$^2$, and excellent in corrosion resistance and workability, comprising, by weight, C:up to 0.030%, Si:up to 2.30%, Mn:up to 3.0%, P:more than 0.0005% and not more than 0.150%, S:up to 0.010%, Ni:up to 2.0%, Cu:more than 0% and not more than 2.0%, Cr:not less than 5.0% and less than 10.0%, N:up to 0.030%, V:not less than 0.01% and not more than 0.10%, and optionally at least one of 0.01 to 0.30% of Ti, 0.01 to 0.30% of Nb, 0.01 to 0.30% of Zr, 0.01 to 0.20% of Al and 0.0002 to 0.0200% of B, the amounts of Si, Mn, P, Ni and Cu being adjusted so that the relation: $Si+Mn+10P+Ni+Cu>1.0\%$ may be satisfied, the balance being iron and unavoidable impurities.

3 Claims, No Drawings

CHROMIUM CONTAINING HIGH STRENGTH STEEL SHEET EXCELLENT IN CORROSION RESISTANCE AND WORKABILITY

RELATED APPLICATION

This application is a continuation-in-part to our abandoned application Ser. No. 07/907,512 filed on Jul. 1, 1992, which is a continuation-in part application to our abandoned application No. 07/811,376 filed on Dec. 20, 1991.

FIELD OF THE INVENTION

The invention relates to a chromium containing high strength steel sheet which is excellent in mechanical workability and has good corrosion resistance. The steel sheet according to the invention is suitable for use in the manufacture of automobile bodies and other shaped articles. The steel according to the invention is delivered on market in the form of hot rolled strip or sheet, or cold rolled strip or sheet. These products are generally referred to herein as steel sheets.

PRIOR ART

For a purpose of achieving high grade rust proof in automobile bodies and for a purpose of enhancing corrosion resistance and reliability of architectural materials, various types of surface treated steel sheets, in particular galvanized steel sheets have been recently used increasingly, in place of conventional mild steel sheets.

Particularly, in the art of automobile, it is eagerly desired to reduce exhaust gas amounts and to improve fuel cost, in response to the world wide increasing concern about environmental pollution. As one of the effective counter measures, it is practiced to make automobile bodies light in weight by using high strength steel sheets. High strength steels for automobile bodies include dissolution strengthened steels having dissolved Si and Mn, transformation strengthened steels wherein transformed second phases such as martensite and benite phases are utilized, precipitation strengthened steels and steels wherein combined strengthening mechanisms are utilized. Steel sheets of these high strength steels are also utilized as a substrate in the production of surface treated steel sheets. In order to appreciably lighten automobile bodies in weight, it is necessary to use steel sheets having a tensile strength of at least 40 kgf/mm$^2$.

The surface treated steel sheets include hot dip coated steel sheets and electrically plated steel sheets. In order to provide surface treated steel sheets having a further improved corrosion resistance it has been practiced to increase an amount of coating or plating metal, to coat or plate an alloy or to apply composite coating or plating layers. While the surface treated steel sheets have an excellent corrosion resistance, they suffer from such a problem that when press formed, for example, deeply drawn, they frequently invite a trouble called 37 powdering" or "flaking" in the art, that is splintering off of the coating or plating layer. Another problem is that they do not necessarily have a satisfactory spot- and arc-weldability. The problems are particularly serious in cases wherein the coating or plating layer is made thicker to improve corrosion resistance.

There are proposed steel sheets whose corrosion resistance is improved not by means of surface treatment. For example, JP A 2-156048 discloses chromium containing steel sheets having 3 to 12% of Cr and relatively small amounts of Cu, Ni, Al and Ti. JP B 1-53344 discloses Cr containing corrosion resistive steel sheets having Ti-Al added so as to enhance forming workability. Likewise, JP A 2-50940 discloses Cr containing corrosion resistive steel sheets having Nb-Al added so as to enhance deep drawability.

U.S. Pat. No. 4,790,977 to Daniels discloses and claims a ferritic steel alloy having good creep strength and cyclic oxidation resistance at elevated temperatures, consisting essentially of, weight percent, from about 0.01% to about 0.3% (preferably from above 0.06% to 0.15%) carbon, about 2% maximum manganese, greater than 2.35% to about 4 (preferably about 2.5% to about 3.75%) silicon, about 3% to about 7% (preferably about 3% to 5%) chromium, about 1% maximum nickel, about 0.15% (preferably about 0.1%) maximum nitrogen, the sum total of carbon and nitrogen preferably not exceeding 0.2%, less than 0.3% aluminum, at least one carbide and nitride forming element selected from the group of niobium, tantalum, vanadium, titanium and zirconium in an amount up to 1.0% sufficient to maintain a ferritic structure, provide a fine grain size, and pin the grain boundaries to improve creep strength and control the level of carbon and nitrogen in solution to prevent austenite formation and the balance essentially iron.

PROBLEMS THE INVENTION AIMS TO SOLVE

Steels taught by JP A 2-156048 contain Cu and Ni capable of strengthening steel by dissolution therein. However, Cu and Ni are added for a purpose of enhancing corrosion resistance, and all steels specifically disclosed therein have an insufficient tensile strength of 38 kgf/mm$^2$ or less. While some of steels specifically disclosed in JP B 1-53344 are incorporated with Cu and Ni, their strength is still insufficient.

On the other hand, while the addition of carbide- and nitride-forming elements, such as Ti, Nb and Al, to a low chromium steel, as taught by JP B 1-53344 and JP A 2-50940 is advantageous to enhance forming workability of the steel, it is not necessarily sufficient to realize desired levels of strength and corrosion resistance. Accordingly, steel sheets having a combination of high strength, good workability and corrosion resistance, which is not attained by surface treatment, have not been existing.

Incidentally, corrosion resistive stainless steels are known. They are, however, economically disadvantageous because of their large content of Cr, Furthermore, different from a cold rolled sheet of conventional mild steel which is corroded on a whole surface, with corrosion resistive stainless steel sheets corrosion proceeds, while locally forming pits, which may pose a problem in some cases wherein a deep corrosion depth should be avoided.

U.S. Pat. No. 4,790,977 is directed to a high Si, low Cr ferritic steel alloy for use at elevated temperatures having good creep strength and cyclic oxidation resistance at elevated temperatures, and does not address to a chromium containing high strength steel sheet excellent in mechanical workability and corrosion resistance as intended herein.

SUMMARY OF THE INVENTION

We have extensively examined influences of alloying elements on corrosion resistance and workability of chromium containing steel sheets. As a result we have found that a chromium containing steel sheet excellent in corrosion resistance and workability can be obtained by reducing C and N, controlling S in an extremely reduced amount and simultaneously adding not less than 5% and less than 10 % by weight of Cr and a small amount of V. We have further found that the workability can be still enhanced by adding appropriate amounts of Ti, Nb, Zr, Al and/or B. Still further we have found that by adding appropriate amounts of Si, Mn, P, Ni, and Cu, the chromium containing steel sheets can be strengthened without the corrosion resistance being adversely affected and with minimum reduction in the workability. Being based on the findings, the invention provides a high strength chromium containing steel sheet having a tensile strength of at least 40 kgf/mm$^2$, which comprises, by weight, C: up to 0.030%,
Si: up to 2.30%,
Mn: up to 3.0%,
P: more than 0.005% and not more than 0.150%,
S: up to 0.010%,
Ni: up to 2.0%,
Cr: not less than 5.0% and less than 10.0%,
N: up to 0.030%,
V: not less than 0.01% and not more than 0.10%,
Cu: more than 0% and not more than 2.0%, the amounts of Si, Mn, P, Ni and Cu being adjusted so that the relation:

$$Si+Mn+10P+Ni+Cu>1.0\%$$

may be satisfied, the balance being iron and unavoidable impurities.

The invention further provides a high strength chromium containing steel sheet excellent in corrosion resistance and workability, which in addition to the above-mentioned alloying elements in the above-mentioned proportions, further comprises, by weight, at least one of 0.01 to 0.30% of Ti, 0.01 to 0.30% of Nb, 0.01 to 0.30% of Zr, 0.01 to 0.20 % of Al and 0.0002 to 0.0200% of B.

With the cold rolled sheets according to the invention, the target of workability intended herein is a combination of a mean Lankford value of at least 1.3 and a relatively high elongation, although depending upon the tensile strength, for example, an elongation of at least 30% in a case wherein the tensile strength is at least 50 kgf/mm$^2$. The mean Lankford value is a measure of deep drawability and is an average of Lankford values in rolling direction, in direction at an angle of 45° to the rolling direction, in direction at an angle of 90° to the rolling direction, and in direction at an angle of 135° to the rolling direction. With the hot rolled sheets according to the invention, the target of workability intended herein is a bore expansion ratio of at least 1.0. This ratio is a measure of burring workability.

FUNCTION

On each alloying element, functions and reasons for the numerical restriction will now be described.

C deteriorates elongation and weldability of the steel, although it strengthen the steel, and therefore, the lower the C, the more preferable. Furthermore, from the view points of deep drawability of cold rolled steel sheets and corrosion resistance, the lower the C, the more preferable. Thus, C should be controlled 0.030% or less, preferably 0.010% or less.

Si is an element which is effective for deoxygenation and for strengthening the steel by dissolution in a ferritic phase. However, an unduly high Si, particularly in the presence of a considerable amount (e.g. not less than 5%) of chromium, reduces toughness thereby rendering the steel susceptible to cracking upon cold rolling or mechanical working. Si should preferably be 2.30% or less.

Mn is an element which is effective to improve hot workability of the steel and toughness of weld zones of the steel. Furthermore, although Mn has a limited ability of strengthening the steel by its dissolution, it is effective to design strengthening of steel by transformation, since Mn is an austenite former serving to lower $A_1$ and $A_3$ transformation points whereby martensite and benite phases may ready be formed in addition to ferritic phase. However, the presence of Mn in excess of 3.0% makes it difficult to form an appreciable amount of ferritic phase thereby to adversely affect workability of the steel, the upper limit for Mn is now set as 3. 0 %.

P is an element which is very effective to strengthen the steel by its dissolution. For this purpose, more than 0.005% of P will be required. However, an unduly high P content acts to lower toughness of the steel, and therefore, the upper limit for P is now set as 0.150 %.

S control is one of the most critical features of the invention. Since S adversely affects corrosion resistance, particularly rust proof property, of low chromium steel, the lower the S, the more preferable. S should be controlled 0.010% or less, preferably 0.005% or less.

Ni and Cu, like Mn, improve toughness of weld zones of the steel and are effective to design strengthening of steel by transformation. Furthermore, they also have an ability of strengthening steel by dissolution therein. Particularly, Cu is effective to solid-solution strengthening. For this purpose, addition of a definite amount (more than 0%), preferably at least 0.01%, of Cu is required. However, addition of excessive amounts of Ni and Cu increases manufacturing costs, and therefore, the upper limit for each of them is now set as 2.0 %.

Cr is an element which is indispensable for enhancing corrosion resistance of the steel. The effect of Cr is still promoted by reduction of S, as mentioned above, and by addition of a small amount of V, as described below. At least 5.0% of Cr is required to realize a desired level of corrosion resistance. However, an excessively high Cr not only invites expensive costs, but also lowers workability of the steel sheet. Furthermore, with steel sheets having an excessively high Cr content, corrosion proceeds, while forming pits which can be deep. Accordingly, it is generally advantageous to control Cr less than 10.0 %.

N is like C the smaller the better from the view point of workability of steel sheets. N should be controlled 0.030% or less, preferably 0.010% or less.

Addition of V is another critical feature of the invention. Conjoint addition of a small amount of V with Cr brings about a further enhancement of corrosion resistance of steel sheets. While the mechanism for this effect of V is not yet exactly understood, it is believed that V serves to promote the formation of Cr coating in passive state. For this effect at least 0.01% of V is required. As the V content increases and exceeds 0.10%, the effect of V to enhance corrosion resistance is saturated and the steel sheet becomes hard. Accordingly, the upper limit for V is now set as 0.10 %.

Ti, Nb, Zr, Al and B are elements which are effective for enhancing deep drawability of cold rolled steel sheets. B further acts to control becoming brittle induced by deep drawing, and is, therefore, effective to improve secondary workability of cold rolled sheets. For these effects, at least 0.01% of Ti, Nb, Zr or Al, or at least 0.0002% of B is required. Excessive addition of these elements does not brings about further improvement to these effects, rather deteriorates surface quality of the products and invites increase in manufacturing costs. Accordingly, the upper limits of 0.30%, 0.20% and 0.0200% are hereby st for Ti, Nb and Zr, for Al and for B, respectively.

In addition to the above prescribed numerical restriction of individual alloying elements, the amounts of Si, Mn, P, Ni and Cu are adjusted so that the relation:

$$Si+Mn+10P+Ni+Cu>1.0\%$$

may be satisfied. The term, Si+Mn+10P+Ni+Cu, is a measure based on an ability of the elements for strengthening the steel sheet due to dissolution thereof in a ferritic phase. In order to achieve a tensile strength of at least 40 kgf/mm$^2$, the above-mentioned term should be adjusted above 1.0 %.

Manufacturing process

While the steel sheets according to the invention are not restricted to any particular manufacturing processes, a cold rolled steel sheet excellent in deep drawability according to the invention can be advantageously by providing a molten steel having a suitable chemical composition by a conventional steel making process, continuously casting the molten steel to a slab, heating the slab to an appropriate temperature within the range between 1100° C. and 1300° C., subjecting the slab to a hot rolling step including a finish pass of hot rolling at a temperature within the range for for forming a single austenitic phase, a controlled cooling to a selected coiling temperature of at least 500° C. and coiling at that temperature to provide a hot rolled strip having a fine grained ferritic structure, pickling the hot rolled strip, cold rolling the pickled strip at high reduction rate of at least 70%, and annealing the cold rolled strip.

A hot rolled steel sheet according to the invention which is mild and excellent in burring workability can be advantageously by continuously casting the a molten steel having a suitable chemical composition to a slab, heating the slab to an appropriate temperature within the range between 1100° C. and 1300° C., and subjecting the slab to a hot rolling step including a finish pass of hot rolling at a temperature within the range for for forming a single austenitic phase, a controlled cooling to a selected coiling temperature of at least 400° C. and coiling at that temperature to provide a hot rolled strip having a fine grained ferritic structure. The schedule of hot rolling passes, the controlled cooling after the finish pass of hot rolling and the coiling temperature should be suitably selected so that the transformation of austenite to fine ferrite may properly proceed and complete. A hot rolled steel sheet according to the invention which is strong and still has good burring workability can be obtained by forming a fine duplex structure of a clear recrystallized ferritic phase and other hard phases in which the transformation to ferrite is not yet completed. This can be realized by selecting a higher cooling rate after the finish pass of hot rolling and a lower coiling temperature. The hot rolled steel sheets may be optionally pickled and/or annealed after coiling.

There are two methods for annealing the hot rolled or cold rolled steel sheet according to the invention. In one method the steel sheet is softened by annealing at a temperature within the range for ferrite. In the other method the steel sheet is strengthened by heating to a higher temperature within the range for austenite, followed by cooling to form a duplex structure of ferritic and transformed phases.

Irrespective of cold rolled or hot rolled, the steel sheet according to the invention of a duplex structure has a better strength-elongation balance than that of a ferritic structure.

The steel sheet according to the invention can also be used as a substrate steel sheet which is to be coated with one or more layers of Zn, Ni, Cu, Al, Pb, Sn, Fe or B, or alloys thereof.

EXAMPLES

The invention will be further illustrated by following examples. Each steel having a component composition indicated in Table 1 was prepared by melting, cast into a strand, which was divided into two halves. One half was hot rolled to to a thickness of 4 mm, descaled, cold rolled to a thickness of 0.8 mm (reduction rate of 80%) and annealed at a temperature of 780° C. for 1 minute to provide a cold rolled strip, which was tested for tensile properties, Lankford value (r) and corrosion resistance. The other half was hot rolled to a thickness of 2.2 mm, and annealed at a temperature of 780° C. for 10 minutes to provide a hot rolled strip, which was tested burring workability by carrying out a bore-expansion test noted below.

Each tensile property was measured on JIS No. 5 test specimens in the rolling direction, in directions at 45° to the rolling direction and in a direction at 90° to the rolling direction, and an average value thereof was calculated. The r value was measured on JIS No. 13B test specimens in the rolling direction, in directions at 45° to the rolling direction and in a direction at 90° to the rolling direction, and an average value ($\bar{r}$) thereof was calculated. Corrosion resistance was examined by carrying out a salt spray test in accordance with JIS Z 2371 for 100 hours. At the end of the period percent area which had gotten rust was determined. Further, an average of depths of the deepest five pits was determined. A bore-expanding test was carried on hot rolled sheet specimens having a pouched bore of an initial diameter of $d_o$ (=10 mm). The specimen was held on a dice equipped with bead by means of a wrinkle preventer in s condition of free from material flow, and the bore was expanded to a final diameter using a conical pounch. The largest final diameter d that invited no cracking of the material was determined. A bore-expansion ratio $\lambda=(d-d_o)/d_o$ was calculated. Results are shown in Table 2.

TABLE 1

| Steel No. | C | Si | Mn | P | S | Ni | Cr | N | V | Cu | Si + Mn + 10P + Ni + Cu | Others |
|---|---|---|---|---|---|---|---|---|---|---|---|---|
| A | | | | | | | | | | | | |
| 1 | 0.0056 | 0.08 | 0.34 | 0.021 | 0.0026 | 0.02 | 5.42 | 0.0038 | 0.05 | 0.01 | 1.66 | |
| 2 | 0.0180 | 0.20 | 2.04 | 0.018 | 0.0014 | 0.01 | 9.51 | 0.0072 | 0.07 | 0.03 | 2.46 | |
| 3 | 0.0025 | 0.05 | 0.10 | 0.007 | 0.0010 | 1.06 | 7.10 | 0.0023 | 0.03 | 0.10 | 1.38 | Ti: 0.08 |

TABLE 1-continued

| Steel No. | C | Si | Mn | P | S | Ni | Cr | N | V | Cu | Si + Mn + 10P + Ni + Cu | Others |
|---|---|---|---|---|---|---|---|---|---|---|---|---|
| 4 | 0.0049 | 0.25 | 0.21 | 0.022 | 0.0042 | 0.11 | 6.95 | 0.0080 | 0.06 | 1.53 | 2.32 | Nb: 0.15 |
| 5 | 0.0048 | 1.03 | 0.20 | 0.018 | 0.0007 | 0.03 | 7.23 | 0.0044 | 0.04 | 0.02 | 1.46 | Zr: 0.23 |
| 6 | 0.0243 | 0.23 | 0.23 | 0.086 | 0.0042 | 0.05 | 7.04 | 0.0068 | 0.03 | 0.01 | 1.38 | Al: 0.063 |
| 7 | 0.0047 | 0.22 | 0.22 | 0.021 | 0.0007 | 0.35 | 7.31 | 0.0033 | 0.06 | 0.47 | 1.47 | Ti: 0.06, Nb: 0.04 |
| 8 | 0.0029 | 0.66 | 0.32 | 0.020 | 0.0028 | 0.01 | 9.12 | 0.0025 | 0.07 | 0.01 | 1.20 | Ti: 0.08, B: 0.0030 |
| B | | | | | | | | | | | | |
| 9 | 0.0056 | 1.02 | 0.23 | 0.015 | 0.0030 | 0.01 | 3.40 | 0.0045 | 0.05 | 0.01 | 1.42 | |
| 10 | 0.0096 | 0.31 | 0.95 | 0.023 | 0.0056 | 0.10 | 12.25 | 0.0105 | <0.01 | 0.01 | 1.60 | |
| 11 | 0.0067 | 0.34 | 0.24 | 0.120 | 0.0042 | 0.05 | 12.43 | 0.0088 | <0.01 | 0.02 | 1.85 | Ti: 0.16 |
| 12 | 0.0065 | 0.12 | 0.17 | 0.015 | 0.0035 | 0.02 | 5.69 | 0.0041 | 0.04 | 0.01 | 0.47 | |
| 13 | 0.0070 | 0.10 | 0.21 | 0.015 | 0.0032 | 0.01 | 5.75 | 0.0032 | <0.01 | 0.03 | 0.50 | |
| 14 | 0.0048 | 0.11 | 0.20 | 0.021 | 0.0056 | 0.97 | 6.45 | 0.0050 | <0.01 | 0.50 | 1.89 | |
| 15 | 0.0085 | 0.48 | 2.21 | 0.024 | 0.0151 | 0.08 | 7.11 | 0.0067 | 0.03 | 0.01 | 2.93 | |

Note)
A: Steels according to the invention
B: Control steels

TABLE 2

| | Cold rolled steel | | | | | | Hot rolled steel |
|---|---|---|---|---|---|---|---|
| | Mechanical properties | | | | Corrosion resistance | | Bore expansion ratio |
| Steel No. | YP (kgf/mm²) | TS (kgf/mm²) | El (%) | $\bar{r}$ | Area which got rust (%) | Depth of corrosion (mm) | (λ) |
| A | | | | | | | |
| 1 | 34.6 | 50.2 | 34.6 | 1.43 | 60 | 0.36 | 1.22 |
| 2 | 29.2 | 45.1 | 34.7 | 1.53 | 21 | 0.25 | 1.12 |
| 3 | 24.3 | 45.6 | 35.1 | 1.67 | 43 | 0.28 | 1.30 |
| 4 | 28.7 | 48.8 | 34.4 | 1.39 | 45 | 0.31 | 1.43 |
| 5 | 31.6 | 51.7 | 33.8 | 1.52 | 51 | 0.30 | 1.31 |
| 6 | 33.4 | 50.6 | 34.4 | 1.63 | 48 | 0.30 | 1.21 |
| 7 | 25.9 | 47.3 | 38.5 | 1.72 | 43 | 0.26 | 1.44 |
| 8 | 23.1 | 44.2 | 39.5 | 1.76 | 28 | 0.24 | 1.76 |
| B | | | | | | | |
| 9 | 34.5 | 50.7 | 34.1 | 1.46 | 100 | 0.61 | 1.23 |
| 10 | 32.8 | 46.1 | 34.2 | 0.88 | 24 | 0.37 | 0.91 |
| 11 | 39.6 | 55.0 | 28.9 | 0.95 | 20 | 0.40 | 0.65 |
| 12 | 25.4 | 37.8 | 41.2 | 1.65 | 65 | 0.38 | 1.55 |
| 13 | 25.2 | 38.0 | 40.6 | 1.55 | 96 | 0.45 | 1.45 |
| 14 | 33.7 | 49.4 | 30.7 | 1.30 | 82 | 0.30 | 1.04 |
| 15 | 30.4 | 45.4 | 34.3 | 1.40 | 90 | 0.35 | 1.12 |

Note)
A: Steels according to the invention
B: Control steels

As seen from Table 2, cold rolled steel sheets according to the invention have a tensile strength of at least 40 kg/mm², a good elongation and excellent forming workability such as deep drawability as represented by an average $\bar{r}$ value of at least 1.3. They further have excellent corrosion resistance as represented by low percent area which got rust and small corrosion depth in the salt spray test. Hot rolled steel sheets according to the invention have excellent forming workability such as burring workability as represented by a large bore-expansion ratio of at least 1.0.

In contrast, Control steel No. 9 has a Cr content as low as 3.40%, and, therefore, it has poor corrosion resistance although it has good workability.

Control steels Nos. 10 and 11 respectively contain 12.25% and 12.45% of Cr, in excess of the upper limit for Cr prescribed herein, and, therefore, cold rolled sheets made these steels is unsatisfactory in deep drawability as revealed by their low $\bar{r}$ values. Further, hot rolled sheets made of Control steels Nos. 10 and 11 have lower bore-expansion ratios.

Control steels Nos. 12 and 13 having Si+Mn+10P+Ni+Cu as low as 0.47 and 0.50, respectively, and, therefore, have low strength, although their workability is excellent.

Control steels Nos. 13 and 14 which contain no V are poor in corrosion resistance as represented by their larger percent rust area than Steels Nos. 1 and 2 according to the invention which are well comparable with Control steels No. 14 and 15.

Control steel No. 15 having an unduly high S content is poor in corrosion resistance.

While steels according to the invention, which have been made basically ferritic, are illustrated in Examples, it is possible to further strengthen the steel according to the invention by transformation while maintaining its workability and corrosion resistance.

EFFECT OF THE INVENTION

The invention provides a high chromium containing steel sheet excellent in corrosion resistance and workability as a material for use in the manufacture of automobile bodies and other shaped articles for which high grade rust proof and corrosion resistance are desired.

We claim:

1. A high strength chromium containing steel sheet having a tensile strength of at least 40 kgf/mm$^2$, which comprises, by weight, C: up to 0.030%,
Si: up to 2.30%,
Mn: up to 3.0%,
P: more than 0.005% and not more than 0.150%,
S: up to 0.010%,
Ni: up to 2.0%,
Cr: not less than 5.0% and less than 10.0%,
N: up to 0.030%,
V not less than 0.01% and not more than 0.10%,
Cu: more than 0% and not more than 2.0%, the amounts of Si, Mn, P, Ni and Cu being adjusted so that the relation:

$$Si+Mn+10P+Ni+Cu>1.0\%$$

may be satisfied, the balance being iron and unavoidable impurities.

2. A high strength chromium containing steel sheet having a tensile strength of at least 40 kgf/mm$^2$ which comprises, by weight, C: up to 0.030%,
Si: up to 2.30%,
Mn: up to 3.0%,
P: more than 0,005% and not more than 0.150%,
S: up to 0.010%,
Ni: up to 2.0%,
Cr: not less than 5.0% and less than 10.0%,
N: up to 0.030%,
V: not less than 0.01% and not more than 0.10%,
Cu: more than 0% and not more than 2.0%,
at least one of 0.01 to 0.30% of Ti, 0.01 to 0.30% of Nb, 0.01 to 0.30% of Zr, 0.01 to 0.20% of Al and 0.0002 to 0.0200% of B,
the amounts of Si, Mn, P, Ni and Cu being adjusted so that the relation:

$$Si+Mn+10P+Ni+Cu>1.0\%$$

may be satisfied, the balance being iron and unavoidable impurities.

3. The high strength chromium containing steel sheet in accordance with claim 1 wherein the proportion of S is up to 0.005 %.

* * * * *